US006322187B1

(12) United States Patent
Wyble

(10) Patent No.: US 6,322,187 B1
(45) Date of Patent: Nov. 27, 2001

(54) METHOD FOR SMOOTHING APPEARANCE OF AN INK JET PRINT

(75) Inventor: Thomas L Wyble, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/488,043

(22) Filed: Jan. 19, 2000

(51) Int. Cl.[7] ..... B41J 2/205
(52) U.S. Cl. ..... 347/15; 347/43; 347/98
(58) Field of Search ..... 347/12, 15, 40, 347/41, 43, 98, 95, 46, 100

(56) References Cited

U.S. PATENT DOCUMENTS

| | | | | |
|---|---|---|---|---|
| 4,308,547 | | 12/1981 | Lovelady et al. | 347/46 |
| 4,697,195 | | 9/1987 | Quate et al. | 347/46 |
| 4,751,529 | | 6/1988 | Elrod et al. | 347/46 |
| 4,751,530 | | 6/1988 | Elrod et al. | 347/46 |
| 4,751,534 | | 6/1988 | Elrod et al. | 347/43 |
| 4,797,693 | | 1/1989 | Quate | 347/46 |
| 4,801,953 | | 1/1989 | Quate | 347/46 |
| 5,028,937 | | 7/1991 | Khuri-Yakub et al. | 347/46 |
| 5,041,849 | | 8/1991 | Quate et al. | 347/42 |
| 5,192,959 | | 3/1993 | Drake et al. | 347/42 |
| 5,698,017 | | 12/1997 | Sacripante et al. | 347/42 |
| 5,738,716 | | 4/1998 | Santilli et al. | 106/31.6 |
| 5,788,754 | | 8/1998 | Deardurff et al. | 106/31.59 |
| 5,858,075 | | 1/1999 | Deardurff et al. | 106/31.27 |
| 5,864,350 | * | 1/1999 | Shioya et al. | 347/40 |
| 5,917,509 | | 6/1999 | Becerra et al. | 347/11 |
| 5,931,995 | | 8/1999 | Malhotra et al. | 106/31.58 |
| 5,933,164 | * | 8/1999 | Sato et al. | 347/43 |
| 5,989,325 | | 11/1999 | Sacripante et al. | 106/31.27 |
| 6,123,411 | * | 9/2000 | Inui et al. | 347/43 |
| 6,158,834 | * | 8/1999 | Kato et al. | 347/40 |

* cited by examiner

*Primary Examiner*—N. Le
*Assistant Examiner*—Lamson D. Nguyen
(74) *Attorney, Agent, or Firm*—Oliff & Berridge, PLC

(57) ABSTRACT

A printing method includes printing a colored ink on at least one pixel of a print substrate, and printing a wetting material at least one of under, over and around colored ink in said pixel, wherein said wetting material causes said colored ink to blend into the substrate and blurs edges of the colored ink.

19 Claims, 2 Drawing Sheets

METHOD FOR SMOOTHING APPEARANCE OF AN INK JET PRINT

BACKGROUND OF THE INVENTION

1. Field of Invention

The present invention relates in general to ink jet printing, and methods for smoothing the appearance of ink jet prints. In particular, the present invention relates to methods for smoothing the appearance of ink jet prints to provide photorealistic quality prints on a variety of print substrates.

2. Description of Related Art

Liquid ink printers of the type frequently referred to as continuous stream or as drop-on-demand, such as piezoelectric, acoustic, phase change wax-based or thermal printers, have at least one printhead from which droplets of ink are directed towards a recording medium. Within the printhead, the ink is contained in at least one channel, or preferably in a plurality of channels. Power pulses cause the droplets of ink to be expelled as required from orifices or nozzles at the end of the channels.

In a thermal ink-jet printer, the power pulse is usually produced by a heater transducer or a resistor, typically associated with one of the channels. Each resistor is individually addressable to heat and vaporize ink in one of the plurality of channels. As voltage is applied across a selected resistor, a vapor bubble grows in the associated channel and initially bulges from the channel orifice, followed by collapse of the bubble. The ink within the channel then retracts and separates from the bulging ink, to form a droplet moving in a direction away from the channel orifice and towards the recording medium. When the ink droplet hits the recording medium, a drop or spot of ink is deposited. The channel is then refilled by capillary action, which, in turn, draws ink from a supply container of liquid ink.

The ink jet printhead may be incorporated into either a carriage type printer, a partial-width-array type printer, or a page-width type printer. The carriage type printer typically has a relatively small printhead containing the ink channels and nozzles. The printhead can be sealingly attached to a disposable ink supply cartridge. The combined printhead and cartridge assembly is attached to a carriage, which is reciprocated to print one swath of information (having a width equal to the length of a column of nozzles) at a time on a stationary recording medium, such as paper or a transparency. After the swath is printed, the paper is stepped a distance equal to the height of the printed swath or a portion of the swath, so that the next printed swath is contiguous or overlapping with the previously printed swath. This procedure is repeated until the entire page is printed. In contrast, the page-width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Many liquid inks, and particularly those used in thermal ink jet printing, include a colorant or dye and a liquid, which is typically an aqueous liquid vehicle, such as water, and/or a low vapor pressure solvent. The ink is deposited on the substrate to form an image in the form of text and/or graphics. Once deposited, the liquid component is removed from the ink and the paper to fix the colorant to the substrate by either natural air drying or by active drying. In natural air drying, the liquid component of the ink deposited on the substrate is allowed to evaporate and to penetrate into the substrate naturally without mechanical assistance. In active drying, the recording medium is exposed to heat energy of various types, which can include infrared heating, conductive heating and heating by microwave energy.

These and other designs of ink jet printers have found use in printing single color images (e.g., typically black-and-white images) as well as multi-color and full-color images. Recently, such printers have also found increased use in printing photorealistic, photo-quality images.

Full color printing has become a desired goal of office, as well as home, products. One type of full color printer that has significant potential for fulfilling such a goal is the ink jet printer, due primarily to its low purchase costs combined with its high quality output. Color printing is accomplished by providing multiple layers or separations of ink on the page. Commonly, colors are provided by subtractive combinations of cyan, magenta and yellow inks. To print black, a combination of equal amounts of cyan, magenta and yellow is printed, or a fourth black ink can be used as a substitute. Undercolor removal, a well known process in the printing arts, can be used to print a single layer of black ink as a substitute for the combination of equal amounts of cyan, magenta and yellow. For a fuller discussion of under color removal and its application to electronically derived or created images, reference is made to J. A. C. Yule, *Principles of Color Reproduction,* (John Wiley & Sons, Inc., New York, 1967), pages 294–327. Other full color printing processes may use dry powder or liquid toners.

A problem of ink jet printers, as well as with other types of pixel-addressed printers, is that there remains a need to improve the print quality of the printer. For example, as the use of full-color printing increases, there is an increasing demand for more photorealistic quality prints. This demand exists both in the context of providing high quality prints on specially treated or coated papers, as well as on ordinary office or uncoated paper.

Various approaches have been taken in the art to address this demand and provide high quality prints. For example, various particular ink sets have been developed, various specially coated papers have been developed, and various printing methods have been developed, each in an effort to increase the final print quality of the printers.

U.S. Pat. No. 5,917,509 provides increased print quality by controlling power pulses sent to the multiple liquid ink emitters so as to maximize the number of emitters that can be simultaneously energized while keeping the instantaneous power usage within prescribed boundaries. The multiple emitters are organized into banks of emitters whose numbers are small enough that all emitters within a bank can receive a correct level of power simultaneously without exceeding capacity of a shared power source. A circuit interleaves the power pulses to the emitters so that no bank of emitters are receiving power at the same instant of time.

Many patents have addressed the problem of print quality by providing specifically designed inks and ink sets. For example, U.S. Pat. Nos. 5,989,325 and 5,931,995, the entire disclosures of which are incorporated herein by reference, provide such specific ink sets for use in ink jet printers. In particular, U.S. Pat. No. 5,989,325 provides a nonaqueous ink composition comprised of a vehicle, colorant, and a hydrophobic gelling component. U.S. Pat. No. 5,931,995 provides an ink comprised of (1) a liquid aldehyde, a liquid acid, or mixtures thereof; (2) a solid additive aldehyde compound, a solid additive acid compound, or mixtures thereof; (3) a lightfastness UV absorber; (4) a lightfastness antioxidant; and (5) a colorant. In a similar manner, specific ink sets for improved print quality are provided in, for example, U.S. Pat. Nos. 5,858,075, 5,788,754, and 5,738,716, the entire disclosures of which are incorporated herein by reference.

An alternate means to improve the print quality of ink jet printers is to address the ink drying characteristics on the print medium itself. For example, U.S. Pat. Nos. 5,805,190 and 5,864,350 provide methods whereby the drying and setting characteristics of the ink are altered.

U.S. Pat. No. 5,805,190 discloses an ink jet printing method that forms an image by ejecting a printing property improving liquid, which improves the printing property of ejected ink, onto a printing medium in advance of ejection of the ink onto the printing medium. Next, the ink is ejected over the printing property improving liquid applied on the printing medium. The ink is ejected onto the printing property improving liquid layer under a condition where a specific relational expression of a thickness of a liquid layer of the printing property improving liquid covering a region of the printing medium to be covered with the ink after impacting the ink thereon, a diameter of the ejected ink and ink ejection speed, and so forth is satisfied. In this method, the ink impacts the liquid layer and contacts the printing property improving liquid over the entire surface, before the ink comes into contact with fibers of the printing medium paper. Upon such contact between the ink and the printing property improving liquid, the dyestuff in the ink is coagulated or made insoluble from the surface of the ink droplet. As a result, the flowability of the ink into the paper is lowered.

Likewise, U.S. Pat. No. 5,864,350 discloses an apparatus and method in which an ink and a separate liquid, which insolubilizes or coagulates a dye contained in the ink, are ejected to perform printing. The patent discloses a method that reduces consumption of the liquid in the case of employing a printing method where one pixel is formed by a plurality of scanning cycles of a head, such as when printing a pixel represented by red print data, a yellow ink and a magenta ink, by ejecting the separate liquid only in the final scanning cycle. In this patent also, the separately ejected liquid acts to coagulate the dye and to bond the dye to the paper.

Despite these various attempts to improve print quality, there remains a need in the art for improved methods to improve the print quality of ink jet and other printers. This need exists despite the improved ink materials themselves, because print quality is still constrained by the printing parameters of the printer itself.

For example, a remaining problem that needs to be addressed is the fact that in ink jet printing, only a small number of colors, usually cyan, magenta and yellow, and optionally black, are used to produce all of the colors of an image. As a result, a small number, and often one, pixel is used to darken or lighten a color. This is especially true in gradients, where one color fades into another. In the middle of such a gradient, there is an area where one color is peppered over another color, forming an image in that area that is objectionable and typically of poor quality.

For example, FIG. 1 represents, in simplified form, a gradient from a light color (here, white) to a dark color (here, black) formed by an ink jet printer. In FIG. 1, the gradient is formed by precisely positioning multiple light color ink droplets 1 and multiple dark color ink droplets 2 on the print surface. Although the figure shows a gradient from light to dark, the central portion of the image, which generally is in a form of a checkerboard pattern of alternating light and dark dots, is of poor quality. Similarly, FIG. 2 shows, in simplified form, a dark color ink droplet 2 surrounded on all sides by light color ink droplets 1.

Thus, a need continues to exist in the art for means to improve the print quality of ink jet printers, as well as other pixel addressable printers, to provide photorealistic images of high print quality.

SUMMARY OF THE INVENTION

The present invention addresses the above needs by providing a printing method whereby the print quality is improved to provide photorealistic quality images on a wider variety of substrates. The present invention accomplishes these objectives by printing a clear liquid in combination with the ink droplets, which clear liquid causes the ink droplet to blend into the background, providing a smoother, higher quality image.

In particular, the present invention provides a printing method, comprising:

printing a colored ink on at least one pixel of a print substrate, and printing a wetting material at least one of under, over and around colored ink in said pixel, wherein said wetting material causes said colored ink to blend into the substrate.

In other embodiments, the present invention also provides a printing apparatus for printing an image on a print substrate, comprising:

means for printing a colored ink on at least one pixel of a print substrate, and means for printing a wetting material at least one of under, over and around colored ink in said pixel, wherein said wetting material causes said colored ink to blend into the substrate.

The present invention also provides an ink set for a printer, comprising at least one colored ink, and a wetting material, wherein said wetting material is capable of temporarily solubilizing said colored ink to blend said colored ink on a print substrate.

BRIEF DESCRIPTION OF THE DRAWINGS

These and other advantages and features of this invention will be apparent from the following, especially when considered with the accompanying drawings, in which.

DETAILED DESCRIPTION OF PREFERRED EMBODIMENTS

Figure 1:
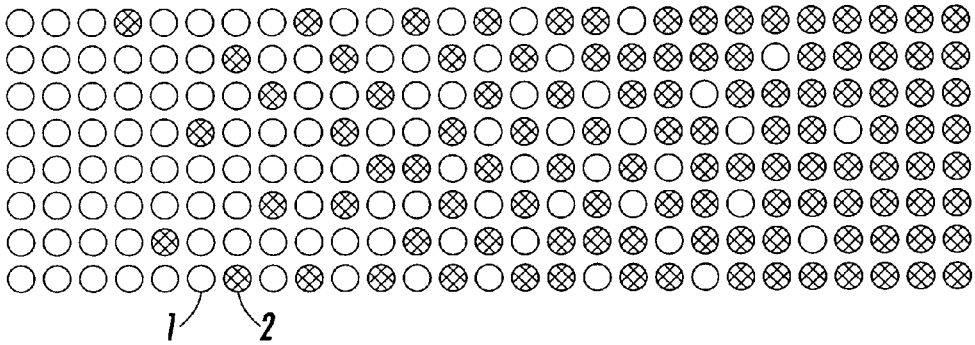
FIG. 1 (PRIOR ART)
FIG. 1 is a simplified depiction of a color gradient from light to dark.

According to the present invention, any suitable ink jet printer can be used, in combination with conventional ink jet inks or ink sets. Suitable printers and inks are disclosed, for example, in the above-referenced U.S. Pat. Nos. 5,738,716, 5,788,754, 5,805,190, 5,858,075, 5,864,350, 5,917,509, 5,931,995, and 5,989,325, the entire disclosures of which are incorporated herein by reference.

According to the present invention, an additional ink supply means, such as a tank, reservoir, or the like, is incorporated into the printer. Thus for example, where the printer is a multi-color printer having four ink supplies, e.g., one each for the colors cyan, magenta, yellow and black, a fifth ink supply can be included. Likewise, where the printer is a one-color printer having one ink supply, e.g., a black ink supply, a second ink supply can be included. Alternatively, an existing ink supply means can be substituted to practice the claimed invention. Thus, for example, where the printer is a multi-color printer having four ink supplies, e.g., one each for the colors cyan, magenta, yellow and black, the black ink supply can be substituted for the ink supply of the present invention. In this embodiment, the color black can still be printed by the printer, for example by printing equal amounts of the cyan, magenta and yellow inks.

In the additional ink supply, a suitable ink material or wetting material, referred to hereafter as a wetting material, can be used to achieve the objects of the present invention. Preferably, the wetting material is a colorless liquid when printed, more preferably clear and colorless. Of course, for particular applications, the present invention in embodiments can use colored wetting materials, if desired. Such colored wetting materials may be used, for example, for particular applications such as when using colored papers.

Furthermore, in embodiments of the present invention, the wetting material is preferably an ink, or a composition having properties substantially similar to the other ink or inks being used in the printer. Thus, for example, it is preferable in embodiments that the wetting material be made from the same components (i.e., solvents, humectants, biocides, and the like) used to make the colored inks, except that in the case of a clear and colorless wetting material, the colorant in the ink is either omitted or is substituted by a clear and colorless material.

In other embodiments, the wetting material can be comprised of any suitable solution or material that helps to disperse the printed ink on the substrate. For example, the wetting material can be a solvent of the colored inks, can be a dispersant of the colored inks, or the like.

According to the present invention, the wetting material preferably has several properties that enable its use. First, the wetting material preferably aids in blending the colored inks into the background of the printed image, where the background can be either a colored image (or portion thereof) or an unprinted background. Second, the wetting material preferably does not overly wet the print substrate, causing unwanted paper cockle and/or curl. Third, the wetting material preferably does not over solubilize any ink that may already be printed on the image, or that may be concurrently or subsequently printed on the image. That is, the wetting material preferably does not destroy the image quality. Finally, the wetting material preferably remains active (i.e., in a wet state) for a period of time sufficient to enable the desired blending of ink to occur. That is, the wetting material must remain active until the desired ink is printed on the substrate, in the case that the wetting material is applied first, without prematurely drying. Furthermore, it is preferred that the wetting material be suitably formulated such that it jets well when used with an ink jet printer, or prints well when used with other printers. Thus, for example in the case of ink jet printing, the wetting material should exhibit jetting performance similar to traditional ink jet inks, and should also exhibit good recoverability of the ink jets, i.e., doesn't excessively dry in the ink jets such that it can't be cleared from the jets by traditional means.

According to the present invention, any suitable wetting material and inks can be used, as are known in the art. For example, typically the inks will contain a colorant and a liquid vehicle, and other optional additives such as humectants, surfactants, biocides, UV absorbers, antioxidants, anti-cockle agents, anti-curl agents, and the like.

By way of example, various ink vehicles that can be used to prepare the inks include, but are not limited to, those illustrated in the above-referenced patents. Specific examples of ink vehicles include, but are not limited to, hydrocarbon liquids, hydrocarbon waxes, oxazolines as described in U.S. Pat. No. 5,698,017, the entire disclosure of which is incorporated herein by reference, organic alcohols, amides, esters, ester-amides, bisteramides, and the like. Suitable hydrocarbon liquids include, for example, the ISO-PAR™ series and NORPAR™ series of solvents (manufactured by the Exxon Corporation), Magiesol, Naphtha, and Terpines. Suitable hydrocarbon waxes include, for example, polyethylene with from about 18 to about 1,000, and preferably from about 25 to about 700, carbon atoms. For example, suitable polyethylene waxes include the Unilin series with, for example, from about 350 to about 700 carbon atoms, and the Polywax series, such as P-500, P-1000. P-3000, and EP-700, all available from Petrolite. The ink vehicle can be present in any of various suitable amounts, for example from about 2 to about 90, and preferably from about 25 to about 50 percent by weight, or parts. The ink vehicle can be a liquid vehicle or a solid vehicle at ambient temperatures, and which vehicles are preferably low viscosity liquids, such as from about 1 to about 10 centipoise at elevated temperatures of from about 50° C. to about 150° C.

Optional lightfast UV absorbers optionally present in the ink compositions can include for example, but are not limited to 2-(2'-hydroxy-5'-methylphenyl)benzotriazole, available as Tinuvin 900, from Ciba Geigy Corporation; 2-[2'-hydroxy-3,5di-(1,1-dimethylbenzyl)phenyl]-2H-benzotriazole, available as Topanex 100 BT, from ICI America Corporation; bis[2-hydroxy-5-tert-octyl-3-(benzotriazol-2-yl)phenyl methane, available as Mixxim BB/100, from Fairmount-Corporation; 2-(3',5'-di-tert-butyl-2'-hydroxyphenyl)-5-chlorobenzo triazole, available as Tinuvin 327, from Ciba Geigy Corporation; 2-(4-benzoyl-3-hydroxyphenoxy)ethylacrylate (Cyasorb UV-416, #41, 321-6, available from Aldrich Chemical Company); tris(3, 5-di-tert-butyl-4-hydroxybenzyl)isocyanurate, available as Good-rite UV 3114, from Goodrich Chemicals; mixtures thereof and the like.

Optional lightfast antioxidants for the ink compositions can include for example, but are not limited to bis-(1,2,3, 6-tetrahydrobenzaldehyde) pentaerythritolacetal, available as Vulkazon AFS/IG, from Mobay Corporation; dioctadecyl 3,3'-thiodipropionate, available as Cyanox, STDP, #41,310-0, from Aldrich Chemical Company; 2,2,4-trimethyl-1,2-hydroquinoline, available as Vulkanox HS, from Mobay Corporation; octylated diphenylamine, available as Anchor ODPA, from Anchor Corporation; N,N'-.β,β'-naphthalene-p-phenylenediamine, available as Anchor DNPD, from Anchor Corporation; ethyl(R)-(+)-2-{4-[trifluoromethyl) phenoxy]phenoxy}propionate, (Aldrich #25,074-0); 3-hydroxy-2,2-dimethylpropyl-3-hydroxy2,2-dimethylpropionate, (Aldrich #39,024-0); mixtures thereof and the like.

Suitable colorants, present in an effective amount generally of from about 1 to about 25, and more specifically for example, from about 2 to about 5 percent by weight, include pigments, dyes, mixtures of pigments, mixtures of dyes, mixtures of pigments and dyes, and the like, with solvent dyes being preferred. Any dye or pigment may be selected providing, for example, that it is capable of being dispersed or substantially dissolved in the vehicle and is compatible with the other ink components.

Examples of suitable pigments include Violet Toner VT-8015 (Paul Uhlich), Paliogen Violet 5100 (BASF), Paliogen Violet5890 (BASF), Permanent Violet VT 2645 (Paul Uhlich), Heliogen Green L8730 (BASF), Argyle Green XP-111-S (Paul Uhlich), Brilliant Green Toner GR 0991 (Paul Uhlich), Lithol Scarlet D3700 (BASF), Toluidine Red (Aldrich), Scarlet for Thermoplast NSD PS PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), Heliogen Blue L6900, L7020 (BASF), Heliogen Blue K6902, K6910 (BASF), Heliogen Blue D6840, D7080 (BASF), Sudan Blue OS (BASF), Neopen Blue FF4012 (BASF), PV Fast Blue B2G01 (American Hoechst), Irgalite Blue BCA (Ciba-Geigy), Paliogen Blue 6470 (BASF), Sudan III (Red Orange), (Matheson, Colemen Bell), Sudan II (Orange), (Matheson, Colemen Bell), Sudan Orange G (Aldrich), Sudan Orange 220 (BASF), Paliogen Orange 3040 (BASF), Ortho Orange OR 2673 (Paul Uhlich), Paliogen Yellow 152,1560 (BASF), Lithol Fast Yellow 0991K (BASF), Paliotol Yellow 1840 (BASF), Novoperm Yellow FGL (Hoechst), Permanent Yellow YE 0305 (Paul Uhlich), Lumogen Yellow D0790 (BASF), Suco-Yellow L1250 (BASF), Suco-Yellow D1355 (BASF), Suco Fast Yellow D1355, D1351 (BASF), Hostaperm Pink E (American Hoechst), Fanal Pink D4830 (BASF), Cinquasia Magenta (Du Pont), Paliogen Black L0084 (BASF), Pigment Black K801 (BASF), and carbon blacks such as Regal 330.RTM. (Cabot), Carbon Black 5250, Carbon Black 5750 (Columbia Chemical Company).

Examples of suitable dyes include Pontamine; Food Black 2; Carodirect Turquoise FBL Supra Conc. (Direct Blue 199), available from Carolina Color and Chemical; Special Fast Turquoise 8 GL Liquid (Direct Blue 86), available from Mobay Chemical; Intrabond Liquid Turquoise GLL (Direct Blue 86), available from Crompton and Knowles; Cibracron Brilliant Red 38-A (Reactive Red 4), available from Aldrich Chemical; Drimarene Brilliant Red X-2B (Reactive Red 56), available from Pylam, Inc.; Levafix Brilliant Red E-4B, available from Mobay Chemical; Levafix Brilliant Red E6-BA, available from Mobay Chemical; Procion Red H8B (Reactive Red 31), available from ICI America; Pylam Certified D&C Red #28 (Acid Red 92), available from Pylam; Direct Brill Pink B Ground Crude, available from Crompton and Knowles; Cartasol Yellow GTF Presscake, available from Sandoz, Inc.; Tartrazine Extra Conc. (FD&C Yellow #5, Acid Yellow #23), available from Sandoz, Inc.; Carodirect Yellow RL (Direct Yellow 86), available from Carolina Color and Chemical; Cartasol Yellow GTF Liquid Special 110, available from Sandoz, Inc.; D&C Yellow #10 (Acid Yellow 3), available from Tricon; Yellow Shade 16948, available from Tricon; Basacid Black X 34, available from BASF; Carta Black 2GT, available from Sandoz, Inc.; and the like.

Particularly preferred are solvent dyes, and within the class of solvent dyes, spirit soluble dyes are preferred primarily because of their compatibility with the ink vehicles. Examples of suitable spirit solvent dyes include Neozapon Red 492 (BASF), Orasol Red G (Ciba-Geigy), Direct Brilliant Pink B (Crompton-Knolls), Aizen Spilon Red C-BH (Hodagaya Chemical Company), Kayanol Red 3BL (Nippon Kayaku Company). Levanol Brilliant Red 3BW (Mobay Chemical Company), Levaderm Lemon Yellow (Mobay Chemical Company), Spirit Fast Yellow 3G, Aizen Spilon Yellow C-GNH (Hodagaya Chemical Company), Sirius Supra Yellow GD 167, Cartasol Brilliant Yellow 4GF (Sandoz), Pergasol Yellow CGP (Ciba-Geigy), Orasol Black RLP(Ciba-Geigy), Savinyl Black RLS (Sandoz), Dermacarbon 2GT(Sandoz), Pyrazol Black BG (ICI), Morfast Black Conc.A (Morton-Thiokol), Diaazol Black RN Quad (ICI),Orasol Blue GN (Ciba-Geigy), Savinyl Blue GLS (Sandoz), Luxol Blue MBSN (Morton-Thiokol), Sevron Blue 5GMF (ICI),Basacid Blue 750 (BASF), and the like.

Of course, in preparing the wetting material for use in the present invention, the colorant is preferably omitted from the ink composition, to provide a colorless composition. Alternatively, clear and/or colorless dye or dye-like materials can be included in the ink composition, to provide properties substantially similar to those of the other inks.

As described above, optional ink additives include biocides such as Dowicil 150, 200, and 75, benzoate salts, sorbate salts, and the like, present in effective amounts, such as for example an amount of from about 0.0001 to about 2 percent by weight, and preferably from about 0.01 to about 1.0 percent by weight. The amount of biocide is generally present in amounts of from about 10 to 25 milligrams per one gram of ink. Other ink additives, such as humectants, and the like can also be incorporated into the inks.

The inks of the present invention can be prepared by any suitable method, such as for example simply mixing, heating, and stirring the components.

Characteristics of the inks of the present invention are as indicated herein, such as a melting point of from about 25° C. to about 70° C., and a viscosity of from 1 centipoise to about 25, and preferably from about 1 centipoise to about 10 centipoise, as measured by Carrim-Med CSL-100 rheometer, available from TA Instrument, at a temperature of from about 50° C. to about 125° C.

According to the present invention, image print quality is significantly enhanced by printing the wetting material at the same, or substantially the same, location as desired ink droplets that are to be blended. For example, the wetting material can be printed under the desired color ink droplet, can be printed around the desired ink droplet, or can be printed under and around the desired ink droplet. Alternatively, the wetting material can be printed over or over and around the desired ink droplet.

Preferably, according to the present invention, the wetting material is printed such that its printed area is at least coextensive with the printed area (prior to or in the absence of blending) of the colored ink droplet to be blended. Thus, the printed area of the wetting material should preferably be the same size as the colored ink area. In embodiments, the printed area of the wetting material can be slightly larger than the printed area of the colored ink droplet. Thus, for example, in embodiments the printed area of the wetting material is from 1.05 to about 4 times the printed area of the colored ink droplet. More preferably, the printed area of the wetting material is from 1.1 to about 3 times the printed area of the colored ink droplet. In this manner, the wetting material affects the desired blending of the colored ink droplet into the background of the printed image.

Figure 2:
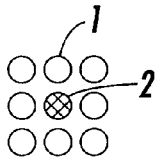
FIG. 2 (PRIOR ART)
FIG. 2 is a simplified depiction of a dark ink dot surrounded by light ink dots.
Figure 3:
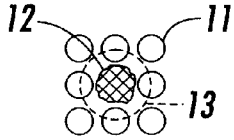
FIG. 3 is a simplified representation of ink drop blending according to the present invention.

By way of representation only, the above-described blending has the effect of blending or blurring the edges of the colored print drop on the substrate. For example, FIG. 3 represents a printed image where a single colored print drop 12 is printed over a wetting material drop 13 (shown as bigger in size than the colored print drop 13 and defined by the dashed line). The drop 12 is surrounded on all sides by different colored drops 11. Due to the presence and action of the wetting material, the colored print drop blends into the background, resulting in less clearly defined boundary lines. This is contrasted, for example, to FIG. 2, which shows the darker color drop as a well-defined drop surrounded by lighter colored drops.

According to the present invention, the desired size and shape of the printed area of the wetting material can be controlled, for example, by controlling the number and/or size of printed droplets of the wetting material. For example, the printing area of the wetting material can be increased by increasing the number of drops of the wetting material printed at a particular pixel location, such as from one drop to two, three or more drops. Alternatively, and more preferably, the printing area of the wetting material can be increased by increasing the number of drops of the wetting material printed at adjacent, such as surrounding, pixel locations. In printers capable of ejecting or printing different sized ink droplets, the printing area of the wetting material can likewise be increased by increasing the size of the printed wetting material in a single pixel.

Figure 4:
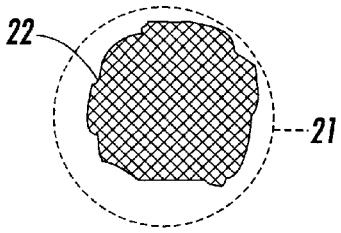
FIG. 4 is a simplified representation of ink drop blending according to the present invention.

In practice, different ink ejectors (nozzles or the like) in a printer typically have slightly different ejection characteristics. Likewise, even the same ejector can exhibit slightly different ejection characteristics depending on, for example, clogging, changes in ink composition, temperature, and the like. That is, it is often possible, and in fact likely, that two ink droplets printed to the same location will in fact be offset to a certain degree, rather than being printed exactly on top of each other. Thus, for example as applies to the present invention, printing a drop of wetting material and a drop of colored ink will not always result in smooth blending of the ink around its entire periphery. For example, FIG. 4 shows the case where a drop of wetting material 21 is printed, followed by a drop of colored ink 22. However, because the drops are not perfectly located, a portion of the drop 22 is not blended.

Figure 5A:
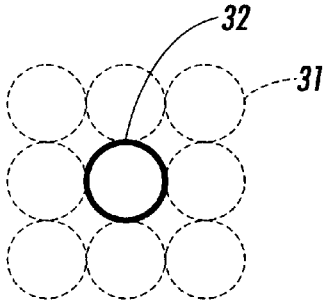
FIGS. 5*a*–5*b* are simplified representations of ink drop blending according to the present invention.
Figure 5B:
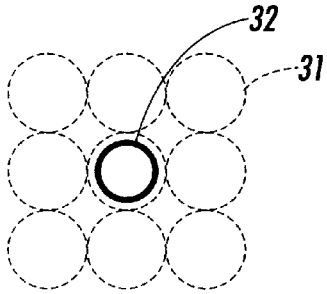

These problems can be overcome, according to embodiments of the present invention, in various ways. For example, as shown in FIG. 5*a,* the blending can be made more even by printing the wetting material 31 around the colored drop 32 (which is shown here as an open circle). Alternatively, as shown in FIG. 5*b,* the blending can be made more even by printing the wetting material 31 both around and under the colored drop 32. Thus, although it is preferred to affect the blending by printing the wetting material only beneath the colored ink drop, in terms of conserving use of the wetting material, improved results are obtained by printing the wetting material both beneath and around the colored ink drops.

According to the present invention, it is preferred that the blending of the colored ink drop be affected around as much of the periphery of the ink drop as possible. Thus, preferably blending occurs around 100% of the periphery of the colored ink drop. However, in embodiments of the present invention, acceptable results may be obtained when blending occurs around at least 75%, more preferably 80%, and most preferably 90%, of the periphery of the colored ink drop.

According to the present invention, the printing process can be implemented according to known programming techniques. For example, suitable image pre-processing procedures, well known in the art for providing acceptable shading, color reduction, and the like, can be utilized to determine the proper and desired placement of the wetting material. Such placement can be software controlled, electronically controlled or the like, as will be readily apparent to those skilled in the art based on the present disclosure.

The present invention is particularly suitable for printing processes wherein the substrate, such as plain paper, coated paper, transparency, or the like, is heated during the printing process to facilitate formation of a liquid crystalline phase within the ink. When transparency substrates are employed, temperatures typically are limited to a maximum of about 100° C. to about 110° C., since the polyester typically employed as the base sheet for the transparency tends to deform at higher temperatures. Specially formulated transparencies and paper substrates can, however, tolerate higher temperatures, and frequently are suitable for exposure to temperatures of about 150° C. or even 200° C. in some instances. Typical substrate heating temperatures are from about 40° C. to about 140° C., and preferably from about 60° C. to about 95° C., although the temperature can be outside these ranges.

The inks of the present invention are also suitable for use in acoustic ink jet printing processes. In acoustic ink jet printing, as described in the above-referenced patents, an acoustic beam exerts a radiation pressure against features upon which it impinges. Thus, when an acoustic beam impinges on a free surface of the ink of a pool of liquid from beneath, the radiation pressure which it exerts against the surface of the pool may reach a sufficiently high level to release individual droplets of liquid from the pool, despite the restraining force of surface tension. Focusing the beam on or near the surface of the pool intensifies the radiation pressure it exerts for a given amount of input power, as described in, for example, *IBM Technical Disclosure Bulletin,* Vol. 16, No. 4, September 1973, pages 1168 to 1170, the disclosure of which is totally incorporated herein by reference. Acoustic ink printers typically comprise one or more acoustic radiators for illuminating the free surface of a pool of liquid ink with respective acoustic beams. Each of these beams usually is brought to focus at or near the surface of the reservoir (i.e., the liquid/air interface). Furthermore, printing conventionally is performed by independently modulating the excitation of the acoustic radiators in accordance with the input data samples for the image that is to be printed. This modulation enables the radiation pressure, which each of the beams exerts against the free ink surface, to make brief, controlled excursions to a sufficiently high pressure level for overcoming the restraining force of surface tension. That, in turn, causes individual droplets of ink to be ejected from the free ink surface on demand at an adequate velocity to cause them to deposit in an image configuration on a nearby recording medium. The acoustic beam may be intensity modulated or focused/defocused to control the ejection timing, or an external source may be used to extract droplets from the acoustically excited liquid on the surface of the pool on demand. The size of the ejected droplets is determined by the waist diameter of the focused acoustic beam. Acoustic ink printing is attractive because it does not require the nozzles or the small ejection orifices which have caused many of the reliability and pixel placement accuracy problems that conventional drop on demand and continuous stream ink jet printers have suffered.

The size of the ejection orifice is a critical design parameter of an ink jet because it determines the size of the droplets of ink that the jet ejects. As a result, the size of the ejection orifice cannot be increased without sacrificing resolution. Acoustic printing has increased intrinsic reliability since usually there are no nozzles to clog. Furthermore, small ejection orifices are avoided, so acoustic printing can be performed with a greater variety of inks than conventional ink jet printing, including inks having higher viscosities and inks containing pigments and other particulate components. Acoustic ink printers embodying printheads comprising acoustically illuminated spherical focusing lenses can print precisely positioned pixels (picture elements) at resolutions that are sufficient for high quality printing of relatively complex images. It has also been determined that the size of the individual pixels printed by such a printer can be varied over a significant range during operation, thereby accommodating, for example, the printing of variably shaded images. Furthermore, the known droplet ejector technology can be adapted to a variety of printhead configurations, including (1) single ejector embodiments for raster scan printing, (2) matrix configured ejector arrays for matrix printing, and (3) several different types of page width ejector arrays, ranging from (i) single row, sparse arrays for hybrid forms of parallel/serial printing to (ii) multiple row staggered arrays with individual ejectors for each of the pixel positions or addresses within a page width image field (i.e., single ejector/pixel/line) for ordinary line printing.

Inks suitable for acoustic ink jet printing typically are liquid at ambient temperatures (i.e., about 25° C.), however in other embodiments the ink is in a solid state at ambient temperatures and provision is made for liquefying the ink by heating or any other suitable method prior to introduction of the ink into the printhead. Images of two or more colors can be generated by several methods, including by processes wherein a single printhead launches acoustic waves into pools of different colored inks. Further information regarding acoustic ink jet printing apparatus and processes is disclosed in, for example, U.S. Pat. Nos. 4,308,547, 4,697,195, 5,028,937, 5,041,849, 4,751,529, 4,751,530, 4,751,534, 4,801,953, and 4,797,693, the entire disclosures of each of which are totally incorporated herein by reference. The use of focused acoustic beams to eject droplets of controlled diameter and velocity from a free-liquid surface is also described in *J. Appl. Phys., vol.* 65, no. 9 (May 1, 1989) and references therein, the disclosure of which is totally incorporated herein by reference.

While the present invention is demonstrated with the above embodiments, there is no doubt many others accomplish the invention. The important aspect of the invention is that a high quality image can be provided by printing a clear ink or other wetting material in combination with a colored ink to cause the colored ink to blend in more smoothly with the background. Furthermore, although the above description has been in reference to a binary or bilevel ink jet printer, there is no reason in principle that the invention would not apply to a gray or other multilevel printer, where ink coverage is a function not only of the presence of a print dot, but also the gray (color) level value of the print dot. Other printing processes that are printed on a pixel by pixel basis also may benefit from the described method of improving print quality. Notably, electrophotographic and ionographic printing methods using a pixel by pixel printing process for forming a latent image for development with dry or liquid toner marking materials, can suffer from decreased image quality. Thus, although the present invention has been described with reference to an ink jet printing system, there is no reason that the present invention can not be applied to such other printing processes, and application of the present invention in such non-ink jet printing processes is fully within the scope of the present invention.

An advantage of the present invention is that the resultant image more closely matches the original image being processed. The present invention thus results in more realistic color rendition, providing resultant images without undesirable or low quality portions.

As will be apparent to one of ordinary skill in the art, numerous changes, alterations and adjustments can be made to the above-described embodiments without departing from the scope of the invention, and the invention is in no way limited to the specific exemplary embodiments described above. One skilled in the art will recognize that the various aspects of the invention discussed above may be selected and adjusted as necessary to achieve specific results for a particular printer application. Thus, the foregoing embodiments are intended to illustrate and not limit the present invention. It will be apparent that various modifications can be made without departing from the spirit and scope of the invention.

Benefits of the present invention, in addition to providing higher quality printed images, as described above, are that fewer different inks or printer components need to be developed and used. In particular, various approaches to printing photo quality images have been to use either different inks or different printheads than are used for regular printing. For example, these solution have been to use diluted inks or entirely different printheads for photo quality printing in place of the regular full strength inks or printheads. In contrast, the present invention allows for the use of a single ink set and/or printhead, which can be used to print regular images or photo quality images. Thus, the present invention avoids the need for costly purchase of additional ink sets or hardware components, and avoids the need for costly redesign of printer systems to print photo quality images.

The following examples are illustrative of embodiments of the present invention only, and are not limiting of the invention. It will be apparent, however, that the invention can be practiced with many different types and amounts of materials and can be used for a variety of different uses in accordance with the disclosure above and as pointed out hereinafter.

EXAMPLES

A standard Latour printer with a thermal ink jet cartridge is modified to demonstrate the present invention. In particular, the printer is modified by replacing the cyan ink tank with an ink tank containing a colorless (clear) ink, corresponding to the wetting material of the present invention. This ink is prepared by using an ink composition that does not include the coloring component.

Images are developed that, when printed, will cause single magenta dots to be sparsely laid over a yellow background. These images are control images, which correspond to typical print images without the blending of the present invention.

For comparison, images are developed that, when printed, will cause single magenta dots to be sparsely laid over a yellow background, but in addition have wetting material (encoded in the images as cyan) dots printed (1) under, (2) around, and (3) under and around the magenta dots. These images correspond to the present invention, where the magenta dots are blended into the yellow background.

Each of the above images is printed on photo quality paper, and the resultant images are examined under a microscope to evaluate the dot characteristics. This evaluation demonstrates that use of the wetting material does cause the magenta dots to blend into the yellow background, resulting in smoother images. The best results are obtained when the wetting material is printed both under and around the magenta dots, as this overcomes any misalignment of the ejectors and results in smooth blending around the entire periphery of the magenta dot.

What is claimed is:

1. A printing method, comprising:

printing a colored ink on at least one pixel of a print substrate, and printing a wetting material at least one of under, over and around colored ink in said pixel, wherein said wetting material causes said colored ink to blend into the substrate and blurs edges of said colored ink.

2. The method of claim 1, wherein said printing of said colored ink and said printing of said wetting material is conducted by an ink jet printing process.

3. The method of claim 1, wherein said printing of said wetting material is conducted prior to said printing of said colored ink.

4. The method of claim 1, wherein said printing of said wetting material is conducted concurrent with said printing of said colored ink.

5. The method of claim 1, wherein a printed area of said wetting material is from 1.05 to 4 times a printed area of said colored ink.

6. The method of claim 1, wherein a printed area of said wetting material is from 1.1 to 3 times a printed area of said colored ink.

7. The method of claim 1, wherein said wetting material is a clear ink.

8. The method of claim 1, wherein said wetting material is a colorless ink.

9. The method of claim 1, wherein said wetting material is a clear and colorless ink.

10. The method of claim 1, wherein said wetting material consists essentially of a solvent.

11. The method of claim 1, wherein said wetting material is printed under said colored ink.

12. The method of claim 1, wherein said wetting material is printed around said colored ink.

13. The method of claim 1, wherein said wetting material is printed under and around said colored ink.

14. The method of claim 1, wherein said wetting material is printed over said colored ink.

15. The method of claim 1, wherein said wetting material causes said colored ink to blend into said print substrate over at least 75% of a periphery of said colored ink in said pixel.

16. The method of claim 1, wherein said wetting material causes said colored ink to blend into said print substrate over at least 80% of a periphery of said colored ink in said pixel.

17. The method of claim 1, wherein said wetting material causes said colored ink to blend into said print substrate over substantially an entire periphery of said colored ink in said pixel.

18. A printing apparatus for printing an image on a print substrate, comprising:

means for printing a colored ink on at least one pixel of a print substrate, and means for printing a wetting material at least one of under, over and around colored ink in said pixel, wherein said wetting material causes said colored ink to blend into the substrate and blurs edges of said colored ink.

19. An ink set for a printer, comprising:

at least one colored ink, and a wetting material, wherein said wetting material is capable of temporarily solubilizing said colored ink to blend said colored ink on a print substrate and blur edges of said colored ink.

* * * * *